US008029316B2

(12) United States Patent
Snyder et al.

(10) Patent No.: US 8,029,316 B2
(45) Date of Patent: Oct. 4, 2011

(54) HAND TIGHTENABLE COAXIAL CABLE CONNECTOR

(75) Inventors: Bryan S. Snyder, Corning, NY (US); Brian Derenthal, Horseheads, NY (US); Roger Phillips, Jr., Horseheads, NY (US); Julio Rodrigues, Collierville, TN (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 12/612,768

(22) Filed: Nov. 5, 2009

(65) Prior Publication Data

US 2010/0130061 A1 May 27, 2010

Related U.S. Application Data

(60) Provisional application No. 61/116,770, filed on Nov. 21, 2008, provisional application No. 61/161,599, filed on Mar. 19, 2009.

(51) Int. Cl.
*H01R 9/05* (2006.01)

(52) U.S. Cl. ..... 439/578; 439/583

(58) Field of Classification Search ..... 439/578–585
See application file for complete search history.

(56) References Cited

U.S. PATENT DOCUMENTS

| | | | | |
|---|---|---|---|---|
| 1,971,500 | A | 8/1934 | Palmer | |
| 3,184,256 | A | 5/1965 | Zavertnik | |
| 4,082,475 | A | 4/1978 | Kuder | |
| D265,418 | S | 7/1982 | Chow et al. | |
| D267,506 | S | 1/1983 | Evans | |
| D274,453 | S | 6/1984 | Hayes | |
| D296,579 | S | 7/1988 | Hattori | |
| 5,007,861 | A * | 4/1991 | Stirling | 439/578 |
| 5,297,458 | A | 3/1994 | Smith et al. | |
| 5,316,348 | A | 5/1994 | Franklin | |
| 5,854,556 | A | 12/1998 | Steennis et al. | |
| D413,967 | S | 9/1999 | Yuen | |
| D432,088 | S | 10/2000 | Malak | |
| 6,276,237 | B1 | 8/2001 | Stacy | |
| D475,975 | S | 6/2003 | Fox | |
| 6,817,272 | B2 | 11/2004 | Holland | |
| 6,848,920 | B2 | 2/2005 | Fox | |
| D504,113 | S | 4/2005 | Montena | |
| 6,887,102 | B1 | 5/2005 | Burris et al. | |
| 6,971,912 | B2 | 12/2005 | Montena et al. | |
| D519,451 | S | 4/2006 | Fox | |
| D519,452 | S | 4/2006 | Rodrigues et al. | |
| 7,086,897 | B2 | 8/2006 | Montena | |
| 7,147,509 | B1 | 12/2006 | Burris et al. | |
| 7,189,091 | B1 | 3/2007 | Montena | |
| 7,207,820 | B1 | 4/2007 | Montena | |
| 7,255,598 | B2 * | 8/2007 | Montena et al. | 439/578 |
| 7,300,309 | B2 * | 11/2007 | Montena | 439/578 |
| 7,347,729 | B2 * | 3/2008 | Thomas et al. | 439/583 |
| D569,809 | S | 5/2008 | Montena | |
| D572,197 | S | 7/2008 | Chawgo et al. | |

(Continued)

*Primary Examiner* — Thanh Tam Le
(74) *Attorney, Agent, or Firm* — Foley & Lardner LLP

(57) ABSTRACT

A coaxial cable connector includes a connector body having a forward end and a rearward cable receiving end for receiving a cable and a nut rotatably coupled to the forward end of the connector body. The nut includes a flanged head portion at its forward end and a tubular body portion extending rearwardly from the head portion over the connector body and terminating adjacent the rearward cable receiving end of the connector body. The flanged head portion is radially enlarged, having an outer diameter greater than a maximum outer diameter of the tubular body portion, and the tubular body portion preferably surrounds more than half the length of the connector body.

14 Claims, 7 Drawing Sheets

U.S. PATENT DOCUMENTS

| | | | | |
|---|---|---|---|---|
| D574,784 | S | 8/2008 | Chawgo | |
| D577,681 | S | 9/2008 | Amidon | |
| D584,235 | S | 1/2009 | Montena | |
| 7,527,524 | B1 * | 5/2009 | Coleman et al. | 439/578 |
| 7,544,094 | B1 * | 6/2009 | Paglia et al. | 439/585 |
| D600,210 | S | 9/2009 | Snyder et al. | |
| 2003/0162439 | A1 | 8/2003 | Rodrigues et al. | |
| 2004/0019585 | A1 | 1/2004 | Fujimoto et al. | |
| 2004/0077215 | A1 | 4/2004 | Palinkas et al. | |

* cited by examiner

HAND TIGHTENABLE COAXIAL CABLE CONNECTOR

CROSS-REFERENCE TO RELATED APPLICATIONS

This application claims the benefit of U.S. Provisional Application No. 61/116,770, filed on Nov. 21, 2008, and U.S. Provisional Application No. 61/161,599, filed on Mar. 19, 2009, the specifications of which are incorporated by reference herein in their entirety for all purposes.

BACKGROUND OF THE INVENTION

The present invention relates generally to connectors for terminating coaxial cable. More particularly, the present invention relates to a coaxial cable connector having an elongated patterned nut for hand-tightening.

It has long been known to use connectors to terminate coaxial cable so as to connect a cable to various electronic devices such as televisions, radios and the like. Prior art coaxial connectors generally include a connector body having an annular collar for accommodating a coaxial cable, an annular nut rotatably coupled to the collar for providing mechanical attachment of the connector to an external device and an annular post interposed between the collar and the nut. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator.

Upon assembly, a coaxial cable is inserted into the cable receiving end of the connector body, wherein the annular post is forced between the foil covered insulator and the conductive shield of the cable. In this regard, the post is typically provided with a radially enlarged barb to facilitate expansion of the cable jacket. The locking sleeve is then moved axially into the connector body to clamp the cable jacket against the post barb providing both cable retention and a water-tight seal around the cable jacket. The connector can then be attached to an external device by tightening the internally threaded nut to an externally threaded terminal or port of the external device.

Most home coaxial cable installations are done by "do-it yourself" lay-persons who simply hand-tighten the coaxial cable connectors to a threaded terminal instead of using a tool. In fact, hand-tightening is desirable in some applications where the user wants to prevent over-tightening of the nut that may result from the use of a hex-type wrench. However, if the connector is not sufficiently hand-tightened, the result is a connection that is not properly seated.

Upon receiving a poor signal, the customer typically immediately calls the cable television (CATV), computer, satellite or telecommunication provider to request repair service. Obviously, this is a cost concern for the CATV, computer, satellite and telecommunication providers, who then have to send a repair technician to the customer's home.

Conventional coaxial cable connectors provided to facilitate sufficient hand-tightening typically include a separate outer barrel that is either pre-assembled or over-molded over the nut of the connector. Obviously, such an additional separate component adds to the cost and complexity of manufacturing the connector.

Accordingly, it is desirable to provide a coaxial connector with structural features to enhance the hand-tightening capabilities of the connector without adding too much to the cost or complexity in manufacturing the connector.

OBJECTS AND SUMMARY OF THE INVENTION

It is an object of the present invention to provide a coaxial cable connector for terminating a coaxial cable.

It is a further object of the present invention to provide a coaxial cable connector having structure to enhance hand-tightening of the nut, while minimizing the cost and complexity of manufacturing the connector.

In the efficient attainment of these and other objects, the present invention provides a coaxial cable connector. The connector of the present invention generally includes a connector body having a forward end and a rearward cable receiving end for receiving a cable and a nut rotatably coupled to the forward end of the connector body. The nut includes a flanged head portion at its forward end and a tubular body portion extending rearwardly from the head portion over the connector body and terminating adjacent the rearward cable receiving end of the connector body. The flanged head portion is radially enlarged, having an outer diameter greater than a maximum outer diameter of the tubular body portion, and the tubular body portion preferably surrounds more than half the length of the connector body.

In a preferred embodiment, the tubular body portion of the nut includes a knurled or otherwise textured outer surface to enhance gripping of the nut by hand. The knurled outer surface preferably has an uneven pattern for improved moldability, wherein the uneven pattern includes a first row of protrusions disposed along a first central axial reference plane, a second row of protrusions disposed along a second central axial reference plane perpendicular to the first central axial reference plane and a series of intermediate rows of protrusions arranged sequentially between and parallel with the first and second rows of protrusions. Each intermediate row of protrusions includes a ramp portion having an outer surface sloping in a direction from the first central axial reference plane to the second central axial plane at an angle of at least ninety degrees when measured from the first central axial reference plane to the outer surface. Also, the angle of the ramp portion outer surface of each row of the series of intermediate rows is preferably greater than the angle of the ramp portion outer surface of a preceding row when moving in a direction from the first row of protrusions to the second row of protrusions.

The coaxial cable connector of the present invention further preferably includes an annular post disposed within the connector body and a locking sleeve movably coupled to the rearward cable receiving end of the connector body for locking a coaxial cable to the connector. The tubular body portion of the nut surrounds more than half the length of the annular post and terminates just short of the forward end of the locking sleeve. Also, the nut is preferably made from a plastic material and, in this case, the connector further includes a tubular metallic insert disposed within the nut.

A preferred form of the coaxial connector, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
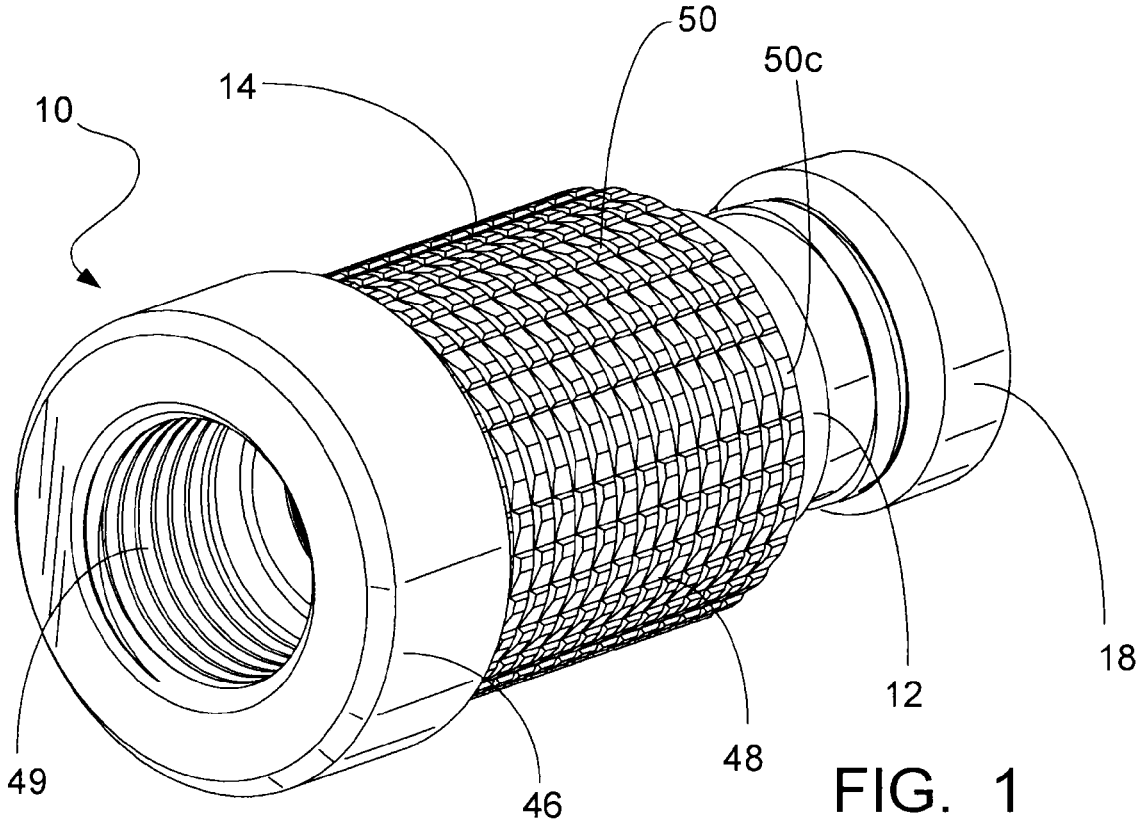
FIG. 1 is a front perspective view of a preferred embodiment of the coaxial cable connector of the present invention.
Figure 2:
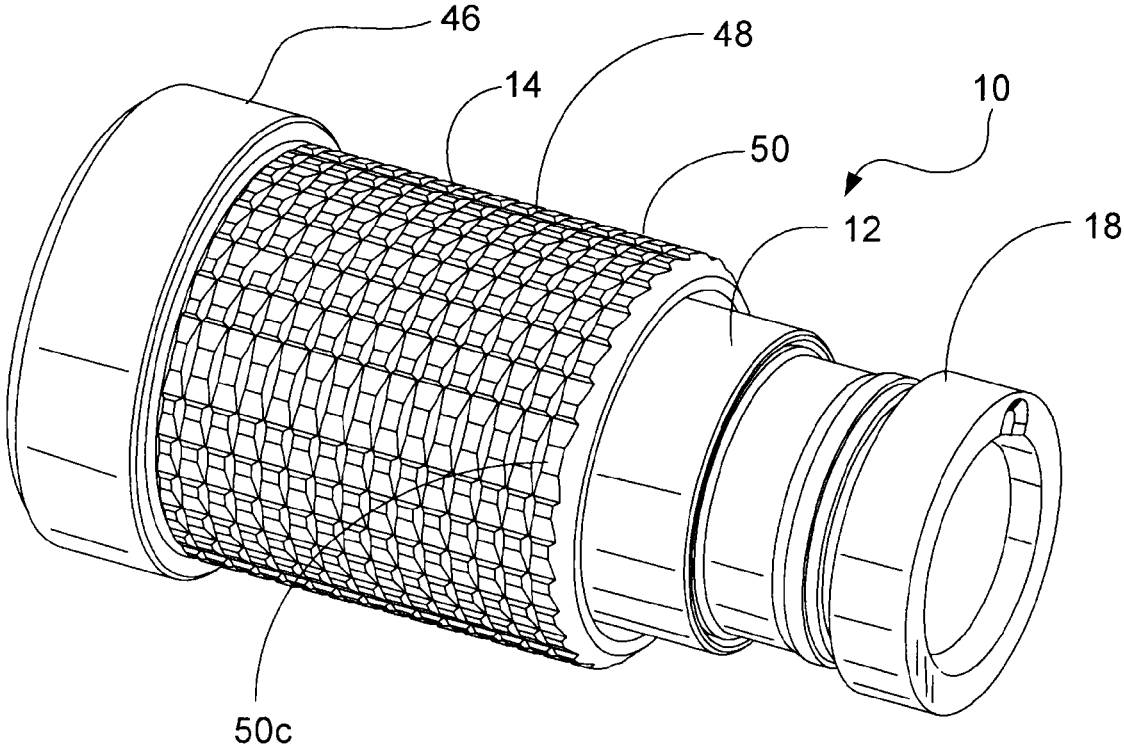
FIG. 2 is a rear perspective view of the connector shown in FIG. 1.
Figure 3:
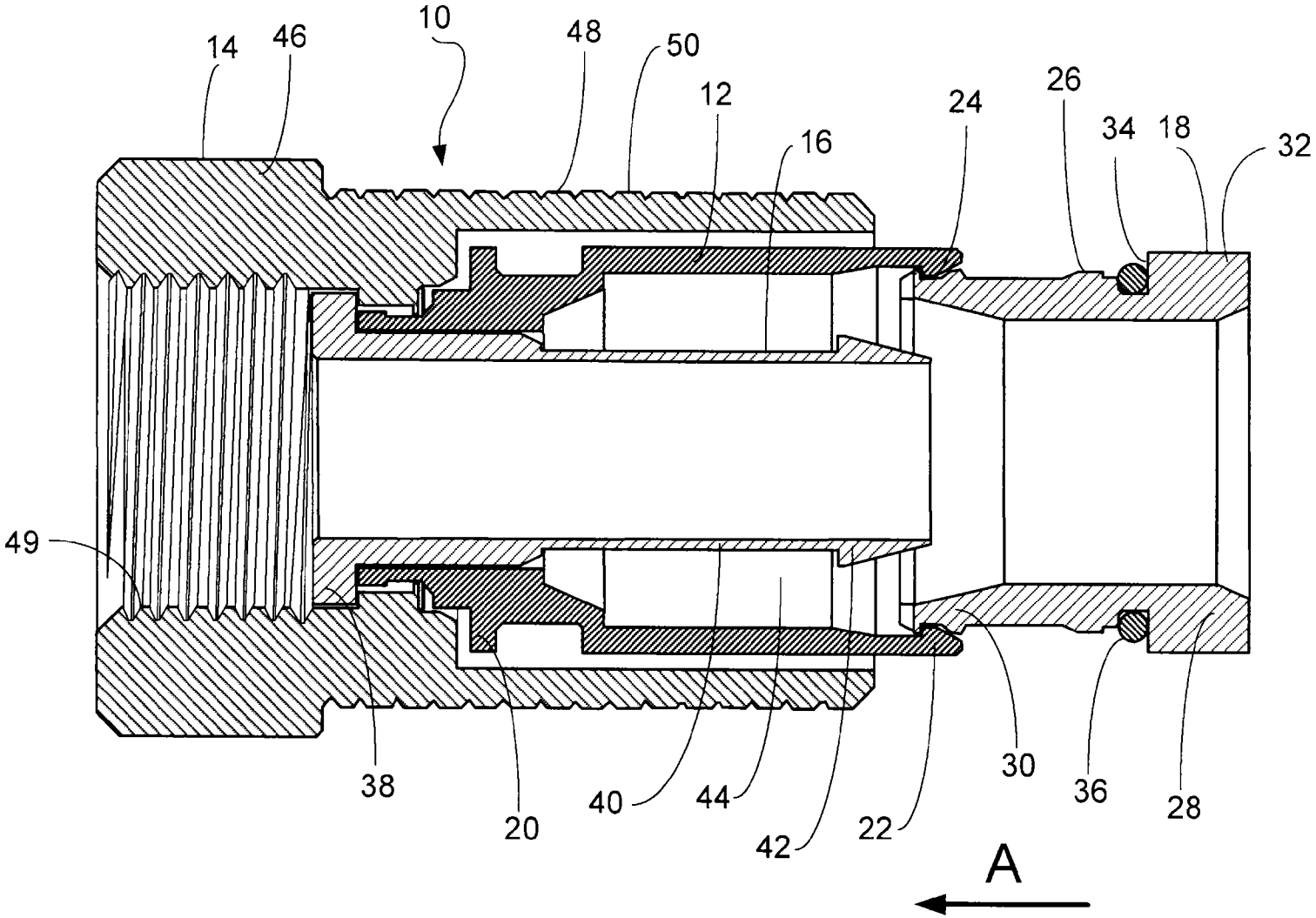
FIG. 3 is a cross-sectional view of the connector shown in FIGS. 1 and 2.

Referring first to FIGS. 1-3, a preferred embodiment of the coaxial cable connector 10 of the present invention is shown. The connector 10 generally includes a connector body 12 and a nut 14 rotatably connected to the connector body. As will be discussed in further detail below, the connector 10 of the present invention further preferably includes an annular post 16 retained within the connector body 12 and a locking sleeve 18 movably coupled to the connector body 12.

The connector body 12, also called a collar, is an elongate generally cylindrical member, which can be made from plastic or from metal or the like. The body 12 has a forward end 20 coupled to both the post 16 and the nut 14, and an opposite cable receiving end 22 for insertably receiving the locking sleeve 18, as well as a prepared end of a coaxial cable in the forward direction as shown by arrow A in FIG. 3. The cable receiving end 22 of the connector body 12 defines an inner sleeve engagement surface for coupling with the locking sleeve 14. The inner engagement surface is preferably formed with detent structure 24, which cooperates with mating detent structure 26 provided on the outer surface of the locking sleeve 18.

The locking sleeve 18 is a generally tubular member having a rearward cable receiving end 28 and an opposite forward connector insertion end 30, which is movably coupled to the inner surface of the connector body 12. As mentioned above, the outer cylindrical surface of the sleeve 18 includes a plurality of ridges or projections 26, which cooperate with the structure 24 formed in the inner sleeve engagement surface of the connector body 12 to allow for the movable connection of the sleeve 18 to the connector body 12 such that the sleeve is lockingly axially moveable along arrow A toward the forward end 20 of the connector body from a first position, as shown for example in FIGS. 1-3, which loosely retains the cable within the connector 10, to a more forward second position, which secures the cable within the connector.

The locking sleeve 18 further preferably includes a flanged head portion 32 disposed at the rearward cable receiving end 28 thereof. The head portion 32 has an outer diameter larger than the inner diameter of the body 12 and includes a forward facing perpendicular wall 34, which serves as an abutment surface against which the rearward end of the body 12 stops to prevent further insertion of the sleeve 14 into the body 12. A resilient, sealing O-ring 36 can be provided at the forward facing perpendicular wall 34 to provide a water-tight seal between the locking sleeve 18 and the connector body 12 upon insertion of the locking sleeve within the body. However, in indoor applications, such O-ring may not be required.

As mentioned above, the connector 10 of the present invention further includes an annular post 16 coupled to the forward end 20 of the connector body 12. The annular post 16 includes a flanged base portion 38 at its forward end for securing the post within the annular nut 14 and an annular tubular extension 40 extending rearwardly within the body 12 and terminating adjacent the rearward end 22 of the connector body 12. The rearward end of the tubular extension 40 preferably includes a radially outwardly extending ramped flange portion or "barb" 42 to enhance compression of the outer jacket of the coaxial cable to secure the cable within the connector 10. The tubular extension 40 of the post 16, the locking sleeve 14 and the body 12 define an annular chamber 44 for accommodating the jacket and shield of the inserted coaxial cable.

The connector 10 of the present invention further includes a nut 14 uniquely designed to provide improved hand-tightening capabilities to the connector without adding additional parts to the connector. Specifically, the nut 14 includes a radially enlarged flanged head portion 46 at its forward end and a tubular body portion 48 extending rearwardly from the head portion over the connector body 12 and terminating adjacent the rearward cable receiving end 22 of the connector body. More specifically, the tubular body portion 48 of the nut 14 extends rearwardly past the axial midway point of both the connector body 12 and the post 16 to thereby surround more than half the length of these components. In a preferred embodiment, the tubular portion 48 covers more than three quarters (¾) the length of both the connector body 12 and the post 16. As can be seen in FIG. 3, the tubular body portion 48 of the nut 14 also preferably extends rearwardly past the barb 42 of the post 16 to a point almost meeting the forward end of the locking sleeve 18.

The nut 14 is rotatably coupled to the forward end 20 of the connector body 12 so as to retain the connector body and the post 16 within the nut. For applications where sealing is desirable, a resilient sealing O-ring (not shown) can be positioned in the nut 14 to provide a water resistant seal between the connector body 12, the post 16 and the nut 14.

The flanged head portion 46 has an outer diameter greater than the outer diameter of the body portion 48 and includes an internally threaded surface 49 adapted for threaded connection with a mating externally threaded port terminal for providing mechanical attachment of the connector 10 to an external device. The larger diameter of the flanged head portion 46 provides two benefits to the nut 14 of the present invention. Both benefits are achieved without the need for extra connector components. First, the enlarged head portion 46 facilitates handling and orientation of the nut 14 in an automatic assembly machine. Second, the head portion 46 provides a positive tactical reference for guiding the installer where to grasp the nut 14 for ideal tightening. Specifically, the head portion 46 includes a peripheral wall 47 extending radially outwardly from the outer surface of the body portion 48. The wall 47, which marks the beginning of the body portion 48, is also preferably axially aligned with the rearward termination point of the internally threaded surface 49 of the head portion. As such, the wall 47 serves as a stop for the installer's fingers for ideal grasping and tightening of the connector 10.

The tubular body portion 48 of the nut 14 preferably includes a knurled or otherwise textured outer surface 50 to enhance gripping of the nut by hand. In a preferred embodiment, the nut 14 is molded from a strong, durable plastic material. The nut 14 can also be molded from a metallic material through a process such as zinc die-casting or metal injection molding.

Figure 4:
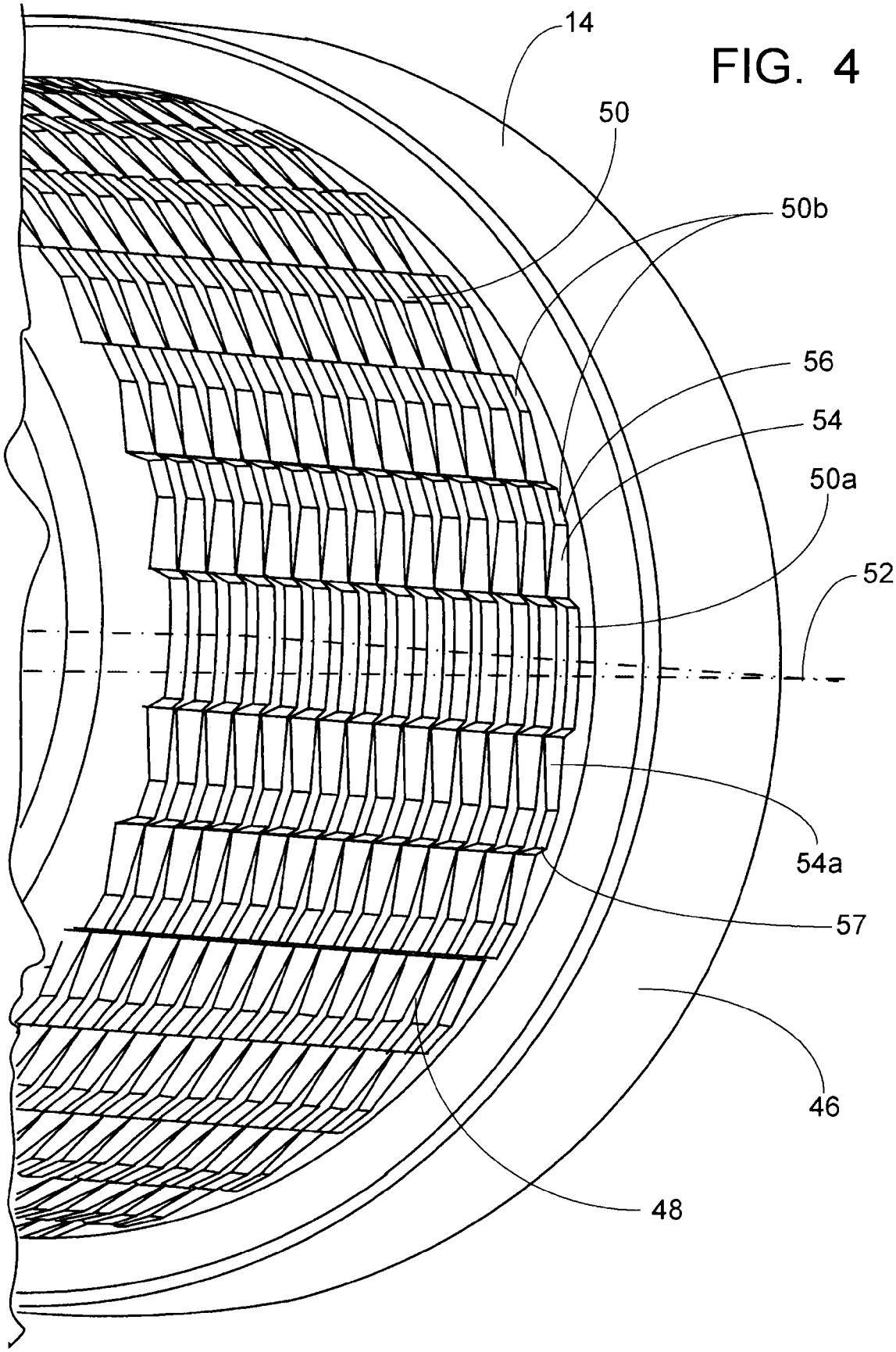
FIG. 4 is an enlarged perspective view of the knurl pattern of the nut.
Figure 5:
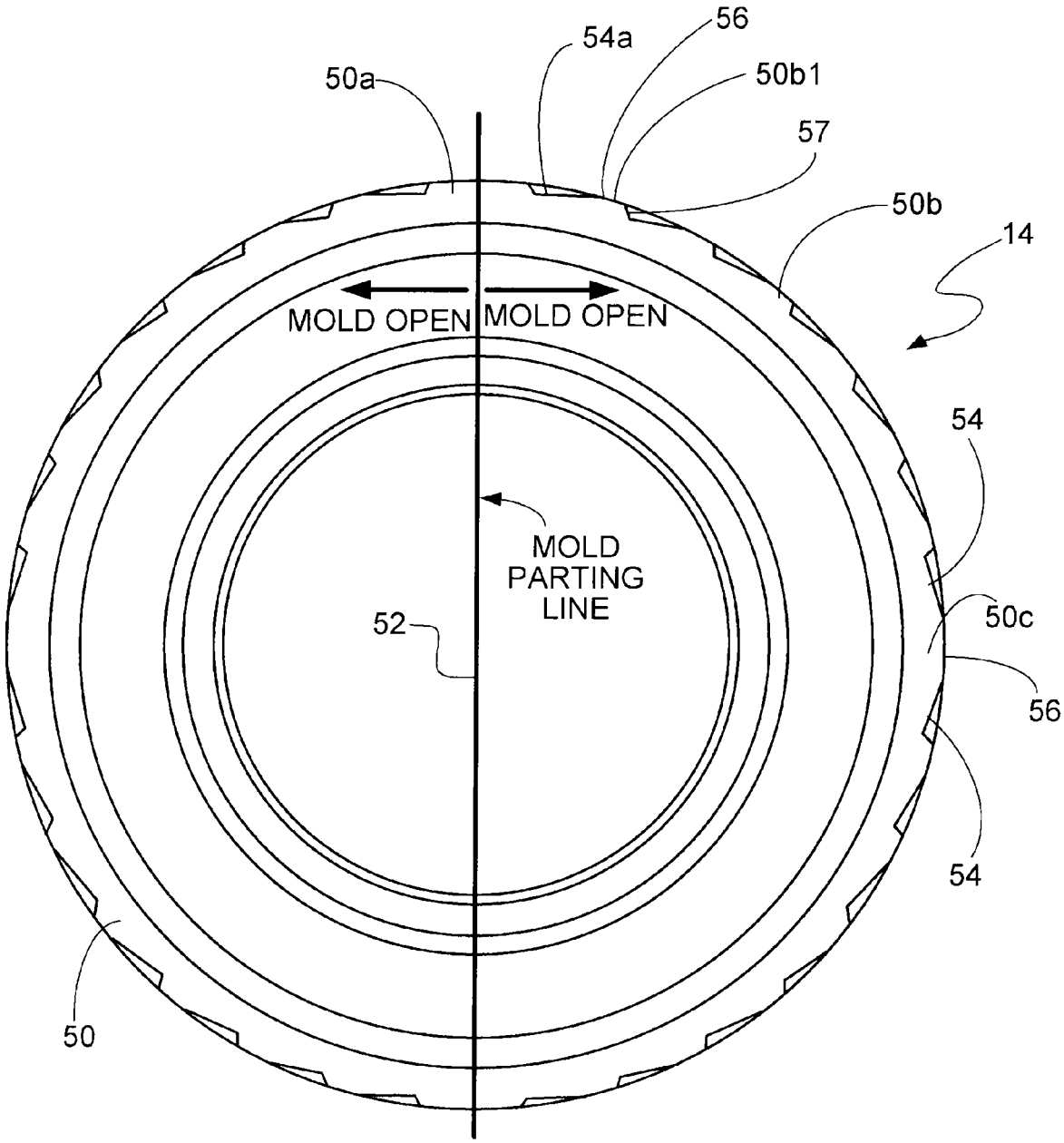
FIG. 5 is an enlarged end view of the nut.

In either case, the body portion 48 is preferably provided with an uneven knurl pattern 50 for improved moldability. Specifically, as shown in FIGS. 4 and 5, the knurl pattern 50 provided on the tubular body portion 48 includes a row 50*a* of raised rectangular protrusions disposed axially along a central axial reference plane 52 on diametrically opposite sides of the body portion. This reference plane 52 is defined by the parting line of two mold halves used to mold the nut 14. Proceeding circumferentially away from the reference row 50*a* of rectangular protrusions is a series of axial rows of ramped protrusions 50*b*.

Each row of ramped protrusions 50*b* includes a first ramp portion 54, a top portion 56 and a second ramp portion 57. The first ramp portion 54 slopes upwardly away from the reference plane 52 to meet the top portion 56 and the second ramp portion 57 slopes downwardly away from the top portion to meet the first ramped portion of the next row of protrusions. The first ramp portion 54*a* of the first row of protrusions 50*b*1 next to the reference row 50*a* is formed at a minimum ninety degree) (90°) angle with respect to the reference plane 52. Each subsequent ramp portion 54, moving away from the reference plane 52, is disposed at increasing angles greater than ninety degree (90°).

The ramped rows 50*b* continue away from the reference plane 52 around the circumference of the tubular portion 48 until they meet with a row of double ramped protrusions 50*c*. The rows of double ramped protrusions 50*c* are disposed at a ninety degree (90°) angle with respect to the reference plane 52 and include two first ramp portions 54 sloping upward on opposite sides of a top portion 56.

Figure 6:
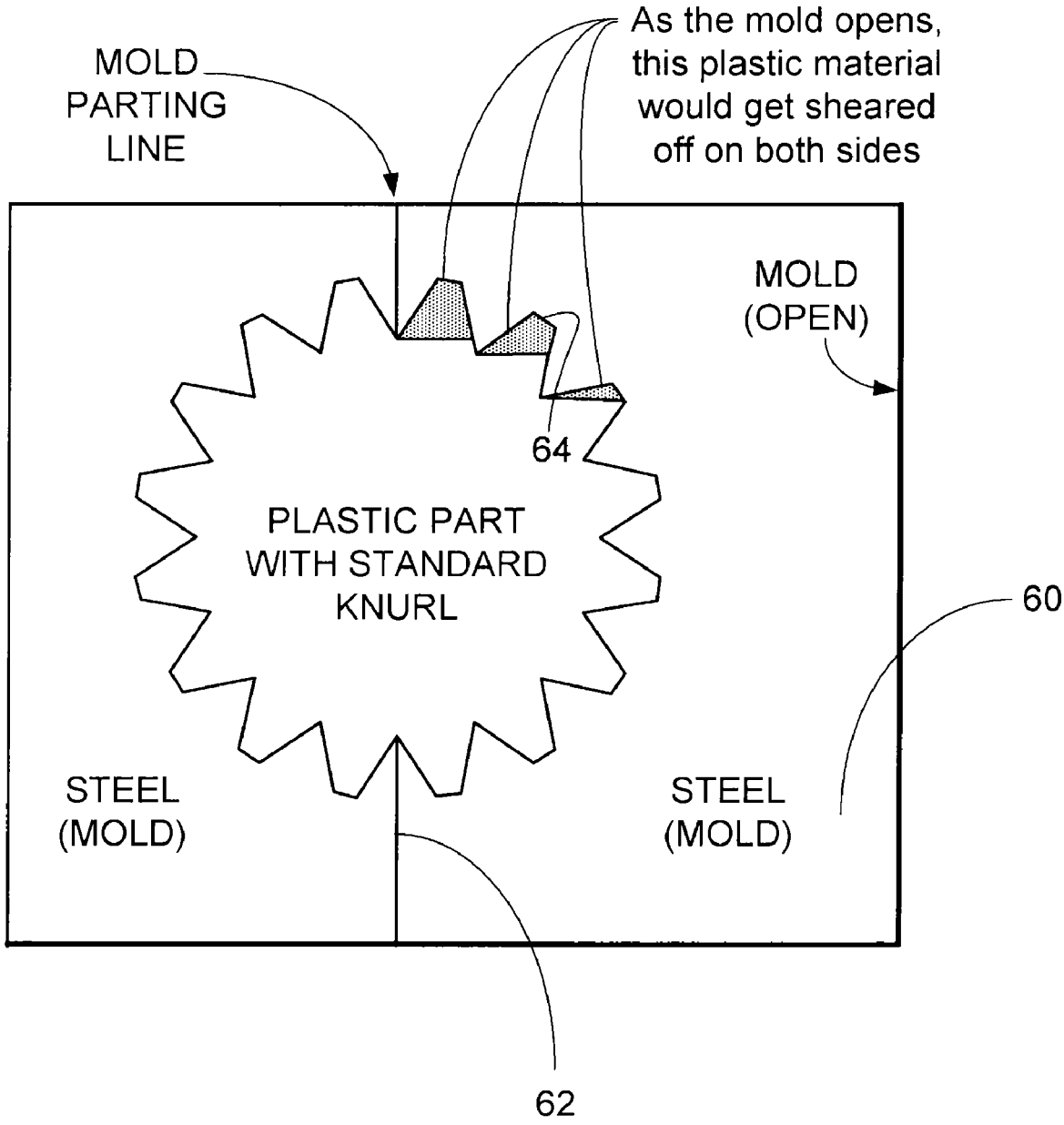
FIG. 6 PRIOR ART
FIG. 6 is a diagrammatic cross-sectional view of a mold molding a conventional knurl pattern on a circular surface.

As a result of this unique knurl pattern design, the nut 14 can be easily molded with the knurl pattern integrally formed in the tubular body portion 48. Such integral molding of conventional knurled surfaces (other than straight, longitudinal knurl or groove pattern) is difficult to achieve. In particular, as shown in FIG. 6, when attempting to mold a conventional knurled pattern into a curved surface, it is often impossible to part the mold halves without destroying a portion of the knurl pattern. For example, as a two part mold 60 opens along its parting line 62, any material molded within recesses 64 of the mold that are formed at an angle of less than ninety degrees (90°) with respect to the mold parting line would be sheared off on both sides. The present invention avoids this by forming the first ramp portion 54*a* of the first row of protrusions at an angle equal to or greater than ninety degree (90°) and all subsequent ramp portions at angles greater than ninety degrees.

The connector 10 of the present invention is constructed so as to be supplied in the assembled condition shown in the drawings, wherein the locking sleeve 18 is pre-installed inside the rearward cable receiving end 22 of the connector body 12. In such assembled condition, a coaxial cable may be inserted through the rearward cable receiving end 28 of the sleeve ring 18 to engage the post 16 of the connector 10. However, it is conceivable that the locking sleeve 18 can be first slipped over the end of a cable and then be inserted into the rearward end 22 of the connector body 12 together with the cable.

In either case, once the prepared end of a cable is inserted into the connector body 12 so that the cable jacket is separated from the insulator by the sharp edge of the annular post 16, the locking sleeve 18 is moved axially forward in the direction of arrow A from the first position shown in FIGS. 1-3 to the second position. This may be accomplished with a suitable compression tool. As the sleeve 18 is moved axially forward, the cable jacket is compressed within the annular chamber 44 to secure the cable in the connector.

Once the cable is secured, the connector 10 is ready for attachment to a port connector, such as an F-81 connector, of an external device. Hand-tightening of the connector 10 is desirable in some applications where the user wants to prevent over-tightening. In these situations, the nut 14 of the present invention provides enhanced hand-tightening capability with its flanged head portion 46 disposed at its forward end and its elongated knurled body portion 48.

In particular, unlike conventional coaxial cable connector nuts, which are typically in the form of a standard hex-nut with little surface area for finger gripping, the nut 14 of the present invention includes an axially elongated body portion 48 extending from a radially enlarged head portion 46 and terminating adjacent the rearward cable receiving end 22 of the connector body. Thus, the nut 14 has an overall length that covers at least a substantial length of the connector body 12, without the need for additional separate connector components. The result is a single nut 14 having increased surface area with which to grip and a radially enlarged head 46, which the fingers can press against to secure the connector to an external device.

Moreover, the design of the present invention is such that the head or flange 46 on the forward end of the nut 14 helps to align the thumb and index finger of the installer for proper positioning and easier aligning of the nut on the port. It also provides better torque by having the fingers and thumb close to the thread 49. Additionally, the knurl 50 was chosen to have superior gripping friction created when being turned by hand and also to be moldable without having points of the knurl being rubbed off when removing the nut from the mold.

Since the design of the knurl pattern 50 was created for superior grip, wrench tightening is not needed and not desired in some cases. Furthermore, because no hex flats were incorporated as a feature, the connector of the present invention is more fail-safe when hand tightened. Specifically, the unique design of the connector is inherently easier and faster to assemble or dis-assemble on a port than conventional F-connectors and therefore the utility of the design is increased for installers or homeowners.

Thus, the present invention eliminates the conventional hex nut and provides a plastic or metal nut 14 that extends all the way to the sleeve 18 of the connector 10. As a result, the number of connector components is reduced, as compared with conventional coaxial connectors that sometimes press-fit a piece of plastic over the nut of the connector. It has also been found that the plastic threads 49 grip a port better than the traditional metal threads, so that the connector of the present invention has better retention and resistance to loosening due to the increased elasticity of the plastic compared to metal.

However, in some situations, use of a plastic nut may result in a decrease of RFI shielding. In these situations, it may be desirable to provide additional shielding around the connection interface between the nut and the external device to prevent RFI leakage.

Figure 7:
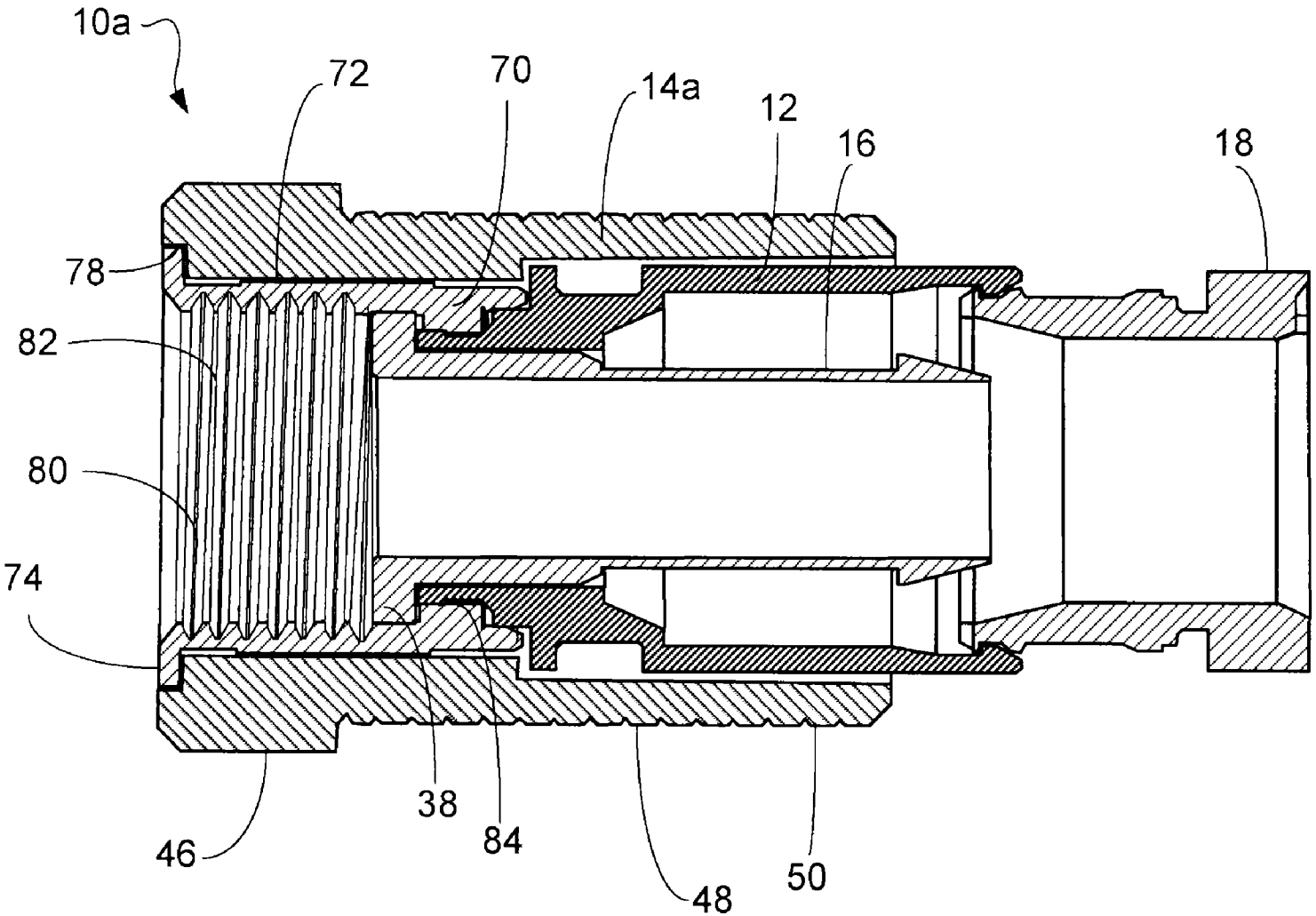
FIG. 7 is a cross-sectional view of an alternative embodiment of the coaxial cable connector of the present invention.
Figure 8:
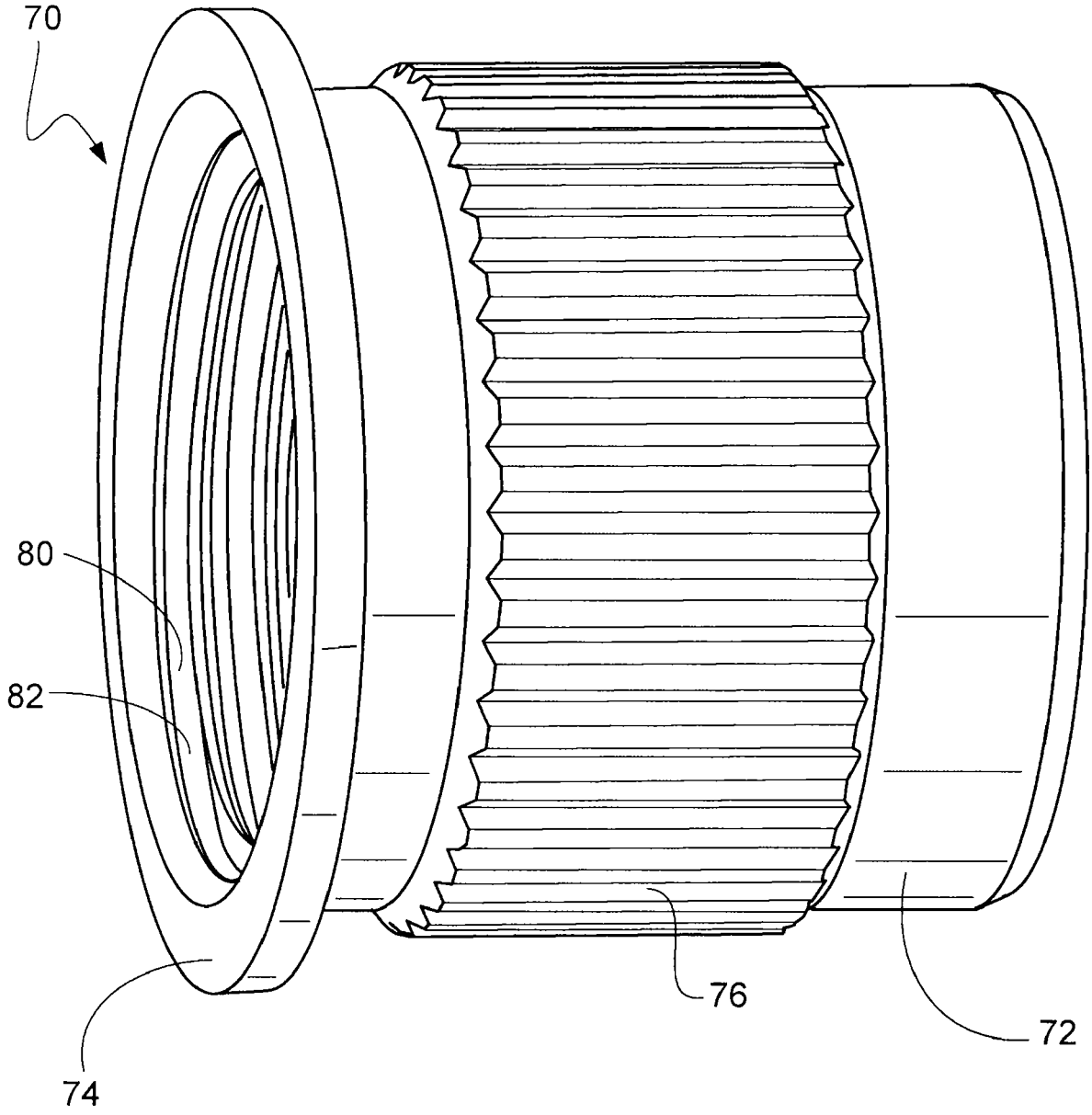
FIG. 8 is a front perspective view of the metal insert of FIG. 7 shown in isolation.

Turning now to FIGS. 7 and 8, where a plastic nut 14*a* is used, the connector 10*a* of the present invention further preferably includes a metallic insert 70 disposed within the plastic nut 14*a* to provide such additional shielding. The metallic insert 70 is a generally tubular member including a body portion 72 and a radially enlarged head portion 74 disposed at the forward end of the body portion. The insert 70 further preferably includes some form of raised structure 76 to facilitate a press-fit engagement between the outer surface of the insert and the inner surface of the nut 14*a* so that the insert will be rotatably and axially fixed within the forward end of the nut. The raised structure 76 can take the form of a plurality of radially arranged axial ribs that rise above the outer surface of the insert 70, as shown in FIG. 8. Alternatively, the raised structure 76 can take some other form, such as an arrangement of protrusions, or a knurled or otherwise textured surface. The insert 70 may also have a smooth outer surface in the press-fit area where it is desirable to minimize stress to the plastic.

In any event, the raised structure 76 is designed to grab or bite into the inner plastic surface of the nut 14*a* to fix the insert 70 within the nut. In this regard, unlike the embodiment described above, the inner surface of the nut 14*a* is not provided with an internal thread, but can instead be left unstructured with the exception of a counter-bore 78 preferably formed at the forward end of the bore. The counter-bore 78 of the nut 14*a* receives the head portion 74 of the insert 70 and stops further rearward insertion of the insert 70 within the nut 14*a* upon assembly. It also helps handling and orientation of the part in automatic assembly machines.

The insert 70 defines an internal bore 80 having an internally threaded surface 82 for engagement with an externally threaded port of a device terminal. The internal bore 80 further includes structure at its rearward end for coupling with the connector body 12 and the post 16. Such structure can be similar to that described above with respect to the first embodiment of the nut 14. Specifically, the internal bore 80 of the nut can be formed with an inwardly extending radial flange 84 designed to both capture the forward end 20 of the connector body 12, and to retain the flanged base portion 38 of the post 16. In this manner, the rearward end of the insert 70 will extend past the forward end 20 of the connector body and the flanged base portion of the post 16 to provide RFI shielding in this area.

Thus, in addition to the benefits described above with respect to the connector 10 shown in FIGS. 1-5, the connector 10*a* shown in FIG. 7 provides the added benefit of increased RFI shielding extending all the way from the forward most end of the nut 14*a* rearwardly past the flanged base portion 38 of the post 16. This additional shielding reduces any RFI leakage that may result from using a plastic nut.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector for coupling a coaxial cable to a mating connector, the connector comprising:

a connector body having a forward end and a rearward cable receiving end for receiving a cable; and a nut rotatably coupled to said forward end of said connector body, said nut including a radially enlarged flanged head portion defining a forward end of said nut and a tubular body portion extending rearwardly from said head portion over said connector body and terminating adjacent said rearward cable receiving end of said connector body, said radially enlarged head portion having an outer diameter greater than a maximum outer diameter of said tubular body portion;

wherein said nut further comprises:

an internally threaded surface extending from said forward end of said nut and terminating at a rearward termination point; and a peripheral wall defining a transition between said radially enlarged head portion and said tubular body portion, said peripheral wall being substantially axially aligned with said rearward termination point of said internally threaded surface.

2. A coaxial cable connector as defined in claim 1, wherein said tubular body portion of said nut surrounds more than half the length of said connector body.

3. A coaxial cable connector as defined in claim 1, wherein said tubular body portion of said nut includes a knurled outer surface to enhance gripping of said nut by hand.

4. A coaxial cable connector as defined in claim 1, wherein said knurled outer surface comprises an uneven pattern for improved moldability.

5. A coaxial cable connector as defined in claim 1, wherein said uneven pattern of said knurled outer surface comprises:

a first row of protrusions disposed along a first central axial reference plane;

a second row of protrusions disposed along a second central axial reference plane, said second central axial reference plane being perpendicular to said first central axial reference plane; and a series of intermediate rows of protrusions arranged sequentially between and parallel with said first and second rows of protrusions, each intermediate row of protrusions including a ramp portion having an outer surface sloping in a direction from said first central axial reference plane to said second central axial plane at an angle of at least ninety degrees when measured from said first central axial reference plane to said outer surface.

6. A coaxial cable connector as defined in claim 1, wherein said angle of said ramp portion outer surface of each row of said series of intermediate rows is greater than said angle of said ramp portion outer surface of a preceding row when moving in a direction from said first row of protrusions to said second row of protrusion.

7. A coaxial cable connector as defined in claim 1, further comprising an annular post disposed within said connector body, said tubular body portion of said nut surrounding more than half the length of said annular post.

8. A coaxial cable connector as defined in claim 1, wherein said nut is made from plastic material, and said connector further comprises a tubular metallic insert disposed within said nut.

9. A coaxial cable connector for coupling a coaxial cable to a mating connector, the coaxial cable connector comprising:

a connector body having a forward end and a rearward cable receiving end for receiving a cable;

an annular post disposed within said connector body, said post having a forward end coupled with said forward end of said connector body;

a tubular metallic insert having a body portion terminating at a rearward end and a radially enlarged head portion disposed opposite said rearward end, said rearward end being rotatably coupled to said forward end of said connector body and said forward end of said annular post, and said body portion having a plurality of radially arranged axial ribs protruding from an outer surface thereof; and a nut made from a plastic material coupled to an outer surface of said tubular metallic insert, said nut having an inner surface defining an axial bore and a counterbore formed at a forward end of said axial bore, said inner surface engaging said axial ribs of said tubular metallic insert for rotatably fixing said insert in said nut and said counterbore receiving said head portion of said tubular metallic for axially fixing said insert in said nut.

10. A coaxial cable connector as defined in claim 9, wherein said nut comprises a radially enlarged flanged head portion defining a forward end of said nut and a tubular body portion extending rearwardly from said heat portion over more than half the length of said connector body and said annular post and terminating adjacent said rearward cable receiving end of said connector body, said radially enlarged head portion having an outer diameter greater than a maximum outer diameter of said tubular body portion.

11. A coaxial cable connector as defined in claim 9, wherein said tubular body portion comprises a knurled outer surface to enhance gripping of said nut by hand, said knurled outer surface having an uneven pattern for improved moldability.

12. A coaxial cable connector as defined in claim 9, wherein said uneven pattern of said knurled outer surface comprises:

a first row of protrusions disposed along a first central axial reference plane;

a second row of protrusions disposed along a second central axial reference plane, said second central axial reference plane being perpendicular to said first central axial reference plane; and a series of intermediate rows of protrusions arranged sequentially between and parallel with said first and second rows of protrusions, each intermediate row of protrusions including a ramp portion having an outer surface sloping in a direction from said first central axial reference plane to said second central axial plane at an angle of at least ninety degrees when measured from said first central axial reference plane to said outer surface.

13. A coaxial cable connector as defined in claim 9, wherein said angle of said ramp portion outer surface of each row of said series of intermediate rows is greater than said angle of said ramp portion outer surface of a preceding row when moving in a direction from said first row of protrusions to said second row of protrusions.

14. A coaxial cable connector as defined in claim 10, wherein said tubular insert further comprises an internally threaded surface extending from a forward end of said radially enlarged head portion of said insert and terminating at a rearward termination point, and wherein said nut further comprises a peripheral wall defining a transition between said radially enlarged head portion of said nut and said tubular body portion of said nut, said peripheral wall being axially aligned with said rearward termination point of said internally threaded surface.

* * * * *